US007654441B2

(12) United States Patent
Billen

(10) Patent No.: US 7,654,441 B2
(45) Date of Patent: Feb. 2, 2010

(54) AIRPLANE CARTON

(75) Inventor: William D. Billen, Topeka, KS (US)

(73) Assignee: Kid Stuff Marketing, Inc., Topeka, KS (US)

( * ) Notice: Subject to any disclaimer, the term of this patent is extended or adjusted under 35 U.S.C. 154(b) by 229 days.

(21) Appl. No.: 11/496,856

(22) Filed: Aug. 1, 2006

(65) Prior Publication Data

US 2008/0029643 A1 Feb. 7, 2008

(51) Int. Cl.
*A63H 33/16* (2006.01)

(52) U.S. Cl. ..... 229/116.4; 229/902; 229/906; 446/488

(58) Field of Classification Search ..... 229/116.4, 229/902, 906; 206/457; 446/76, 488; D9/673
See application file for complete search history.

(56) References Cited

U.S. PATENT DOCUMENTS 1,318,447 A * 10/1919 Hopkins ..... 446/488
D56,696 S * 11/1920 Gudelj ..... D9/673
D60,606 S * 3/1922 Burnup ..... D9/673
1,718,349 A * 6/1929 Gordon ..... 446/488
1,741,468 A * 12/1929 Lange ..... 126/67
1,743,572 A * 1/1930 Schurr ..... 229/116.4
1,759,613 A * 5/1930 Green ..... 229/116.4
1,803,789 A * 5/1931 Burgess ..... 446/488
2,397,364 A * 3/1946 Myers ..... 446/488
4,512,512 A * 4/1985 Fleming ..... 229/904
4,804,133 A * 2/1989 Kiyokane ..... 229/116.4
5,454,508 A 10/1995 Billen
5,458,521 A * 10/1995 Todd ..... 229/116.4

* cited by examiner

*Primary Examiner*—Gary E Elkins
(74) *Attorney, Agent, or Firm*—Chase Law Firm, L.C.

(57) ABSTRACT

A food container has an airplane configuration provided by a cardboard-like sheet having a plurality of spaced fold lines defining a number of panels that are folded along the lines and assembled to provide an airplane-like body having food compartments therein. The panels that extend to the tail of the fuselage are especially configured to provide a unitary tail fin and associated stabilizer that present the tail configuration.

2 Claims, 4 Drawing Sheets

AIRPLANE CARTON

This invention relates to cartons or containers which are formed from a sheet of cardboard or similar material to present an airplane configuration, and which are used to hold food, beverage, or other items to be consumed or enjoyed by the user.

BACKGROUND OF THE INVENTION

Disposable cardboard cartons assembled to provide a food container have been used by restaurants, theaters and other establishments as a convenience for their customers and, in particular, to organize and hold food for children and stimulate a child's interest in the contents of the container. This is particularly the case when dispensing fast food items such as hamburgers and french fries which may be consumed on the premises, and which require a container that securely holds these food items and permits the food-containing tray to be carried to where the food will be consumed and enjoyed. Trays may be formed from a cardboard-like material and assembled from a die-cut sheet by folding the various panels of the sheet, formed by die-cut score lines, into an assembled shape. Simulating the appearance of an airplane creates interest in the presentation of the meal, particularly young children, and holds and organizes the food items in a readily disposable carton.

SUMMARY OF THE INVENTION

In an embodiment of the present invention a food container having an airplane configuration is provided by a cardboard-like sheet having a plurality of spaced fold lines defining a number of panels that are folded along the lines and assembled to provide an airplane-like body having a food compartment therein. One of the panels extends fore and aft and has a rear end configured to provide a stabilizer. A second panel and a third panel present the left and right sides of the body and each has a rear end portion defining a tail fin section which is connected with the stabilizer to present an aircraft tail. In one aspect of the invention, the tail fin sections have aligned slots therein, and the stabilizer has a slot therein receiving the aligned slots in the tail fin sections to present the tail configuration. In accordance with another aspect of the invention, each of the second and third panels has a fold line therein about which the associated tail fin section is folded to an upright position. In another aspect, the folded tail fin sections are engaged in side-by-side relationship to present a unitary tail configuration.

A further aspect is the provision of a second storage compartment in the body of the airplane presented by a bay open at the top of the airplane for receiving other food items.

Other advantages of the airplane carton will become apparent from the following description taken in connection with the accompanying drawings, wherein is set forth by way of illustration and example an embodiment of the present invention.

DETAILED DESCRIPTION

Figure 1:
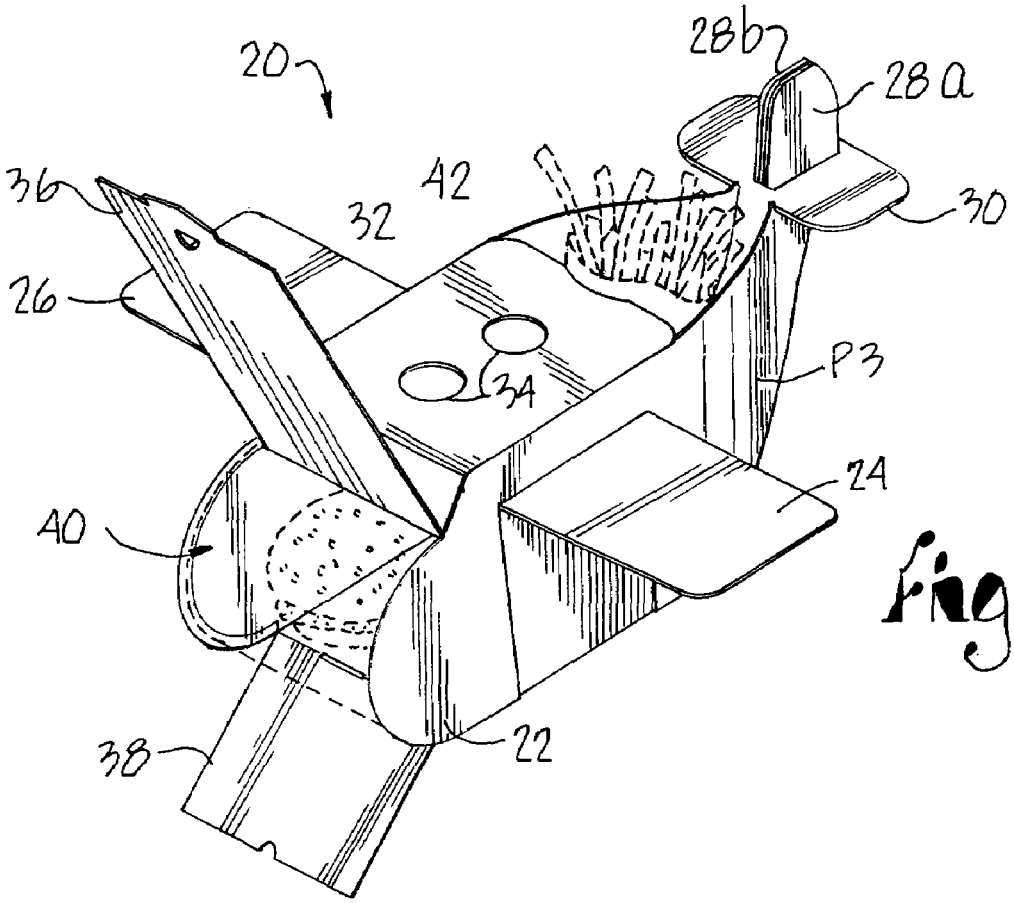
FIG. 1 is a frontal perspective view of the airplane carton, the upper nose section and lower closure flap being shown in their open positions to reveal a food compartment.
Figure 2:
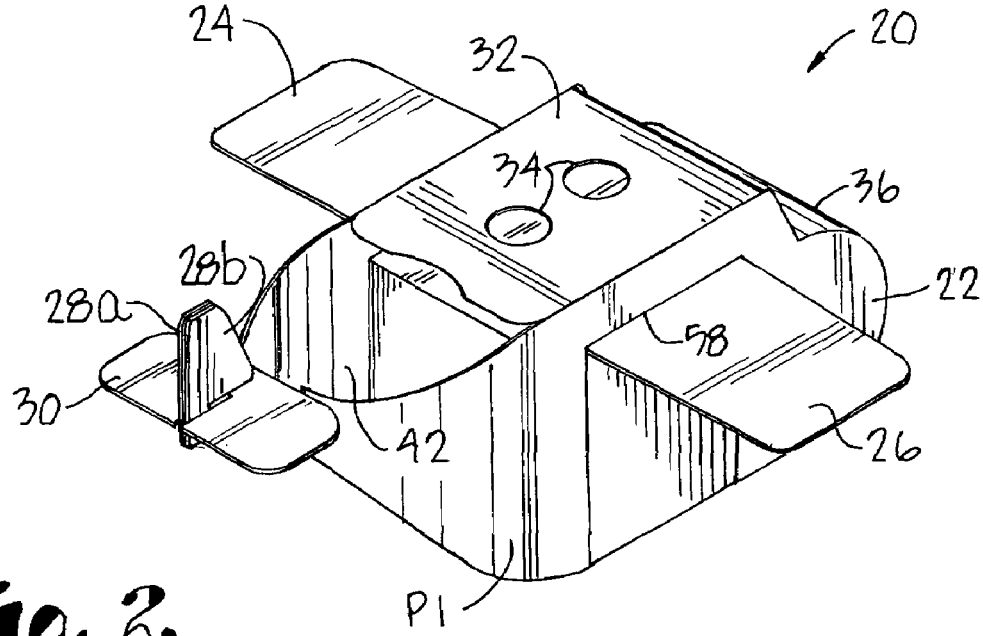
FIG. 2 is a rear perspective view showing the carton fully assembled.
Figure 3:
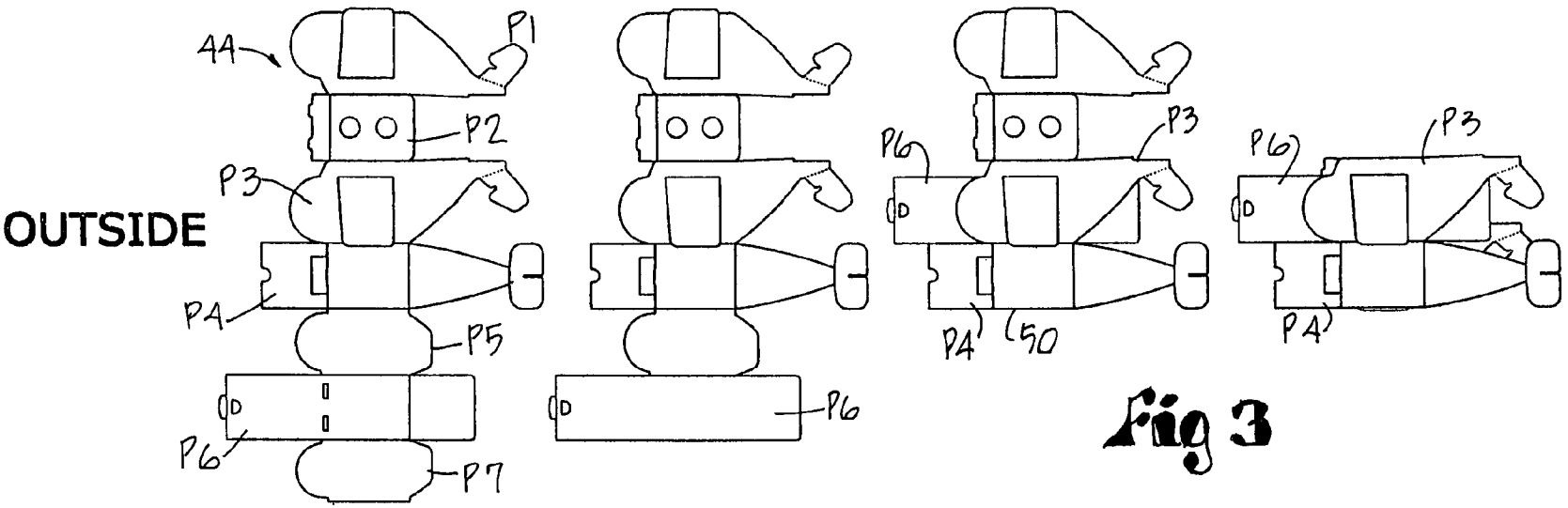
FIG. 3 shows the outside of a cardboard sheet presenting seven shaped panels and associated fold lines, and showing the folding sequence.
Figure 4:
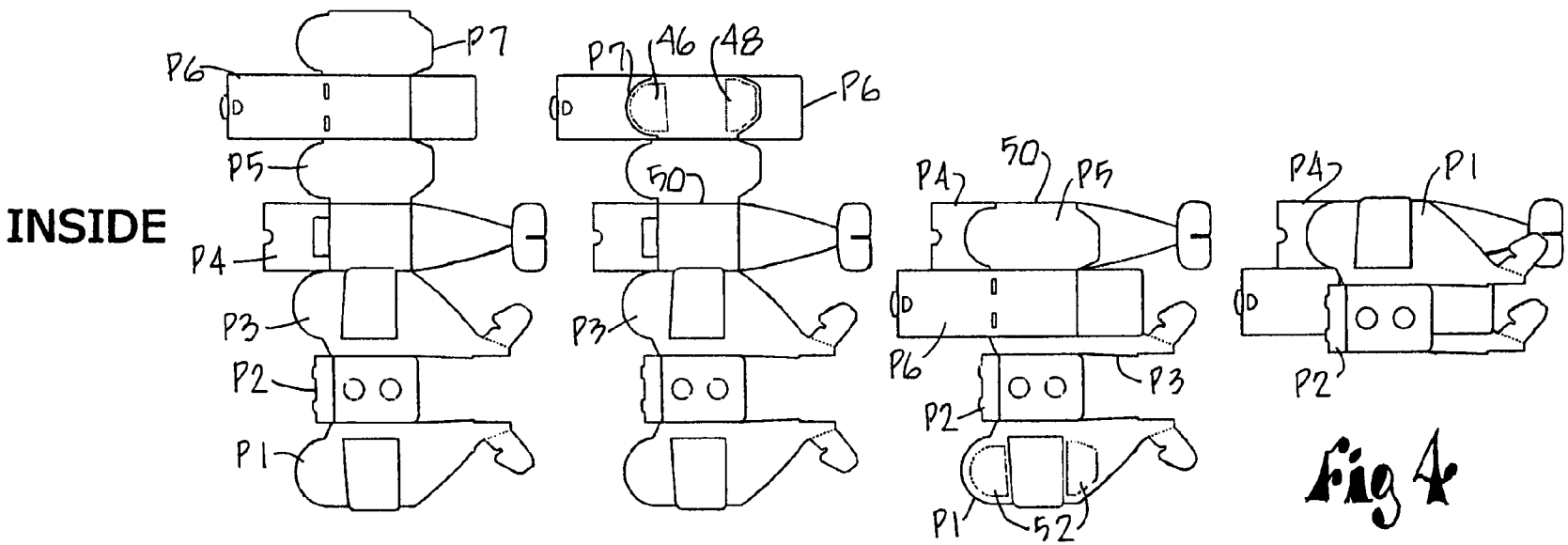
FIG. 4 shows the inside of the cardboard sheet presenting the seven shaped panels and associated fold lines, and showing the folding sequence.

Referring initially to FIGS. 1 and 2, a food container 20 having an airplane configuration is shown fully assembled in front and rear perspective views. Container 20 is presented by an assembled cardboard carton which, prior to assembly, comprises a sheet of material such as paperboard or a similar semi-rigid material capable of retaining fold lines and die cut to the desired shape as shown in FIGS. 3 and 4 to be discussed hereinbelow. A suitable material is 18-point white C1S SBS stock or a thin plastic material capable of retaining fold lines and being folded to a desired configuration.

As assembled in FIGS. 1 and 2, the container or carton 20 comprises a rounded nose 22, a left wing 24, a right wing 26 and a rearwardly extending fuselage terminating in a two-piece tail fin 28*a*, 28*b*, and a horizontal stabilizer 30. A flat top 32 on the fuselage has a pair of spaced holes 34 therein for receiving the fingers of a user so that the carton 20 may be conveniently carried.

A nose section 36 presents a rounded nose when closed as may be seen in FIG. 2. In FIG. 1 the nose section 36 is shown in an open position together with a lower closure flap 38 also shown open. Being composed of flexible paperboard material, or a similar semi-rigid material, the closure flap 38 is swung upwardly to close a main food compartment 40, and the nose section 36 is swung downwardly over the rounded nose 22 to present the closed configuration seen in FIG. 2 and also FIG. 9. The compartment 40 is particularly adapted to hold main course food items inside the airplane that are inserted through the open nose, which is closed after insertion. In addition, a food item such as french fries or a side order or beverage can be held on top of the airplane in a bay 42 behind top 32.

Assembly of the airplane carton from an initially flat sheet 44 is shown in FIGS. 3 and 4. The left illustration in FIG. 3 is the sheet 44 in a flat condition viewed from the outside before folding and gluing. FIG. 4 illustrates the same sheet 44 as viewed from the bottom side of the sheet which will become the inside of the airplane. Sheet 44 comprises seven panels P1, P2, P3, P4, P5, P6 and P7, each of which has the configuration shown in FIGS. 3 and 4. Following the sequential illustrations in FIGS. 3 and 4 from left to right, the left illustration shows the die cut sheet flat before folding, i.e., panels P1-P7 in a common plane. Once folded along the score lines and assembled as set forth below, panel P1 will present the right side of the airplane, panel P2 will present the top 32, panel P3 will present the left side of the airplane, panel P4 will present the bottom of the airplane, panel P5 will be adhered to the inside of panel P1, panel P6 will present the upper body of the airplane, and panel P7 will be adhered to the inside of panel P3.

The sequential folding of the panels proceeds from left to right in FIGS. 3 and 4. In the second illustration, panel P7 has been folded onto panel P6. Glue is then applied to the outside of panel P7 at areas 46 and 48. The next fold is at fold line 50 and panel P7 is adhered to the inside of panel P3. Glue is then applied to the inside of panel P1 at spaced areas 52. Lastly, panel P1 with glue applied is folded and adhered to the outside of panel P5. Panel P5 is hidden from view by P1 in the final illustration of FIG. 4.

Figure 5:
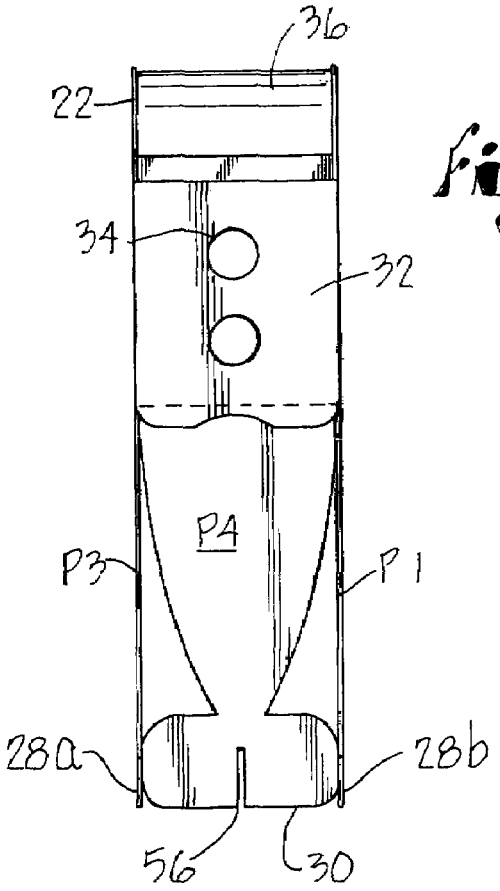
FIG. 5 is a top plan view of the carton during assembly prior to forming the tail portion of the airplane.

FIG. 5 shows the stage of assembly after folding and gluing as described above with reference to FIGS. 3 and 4. Panels P1 and P3 define the sides of the aft portion of the fuselage, and panel P4 will define the bottom of the fuselage (and the bottom of bay 42) when assembly is complete. As is apparent, panels P1, P2 and P4 are tapered from mid-fuselage to the tail.

Figure 6:
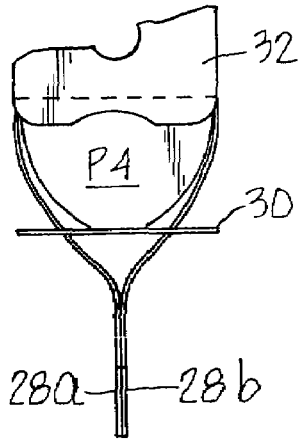
FIG. 6 is a fragmentary, top plan view showing the tail section partially assembled.
Figure 7:
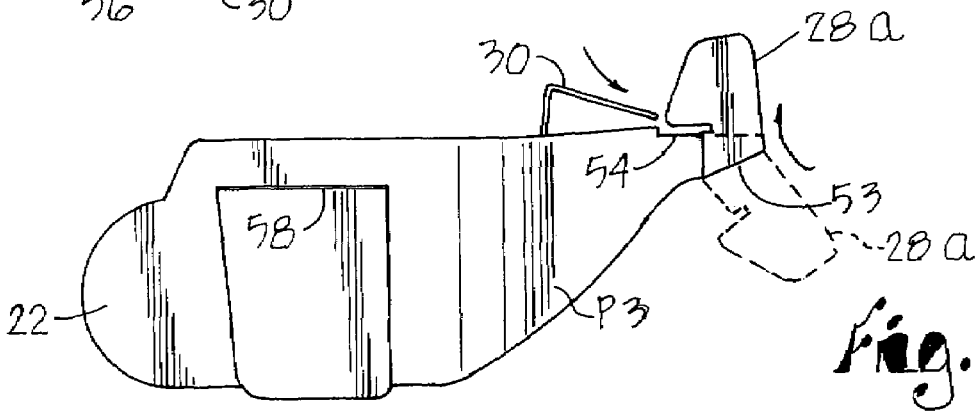
FIG. 7 is a side elevational view illustrating the assembly of the tail section.
Figure 8:
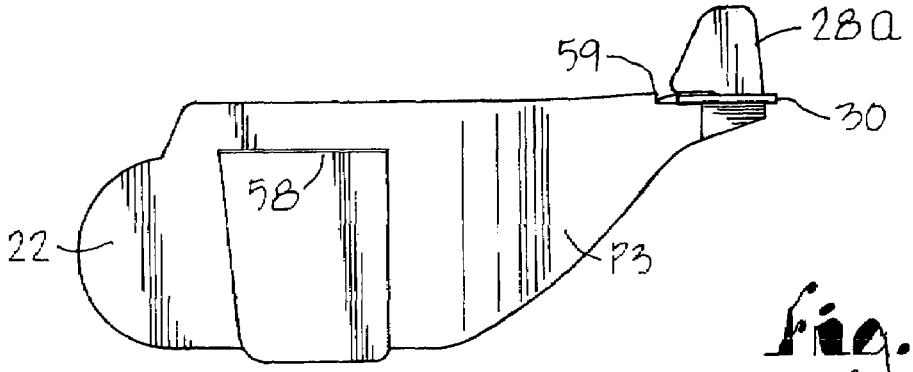
FIG. 8 is a side elevational view similar to FIG. 7 but showing the tail section fully assembled.
Figure 9:
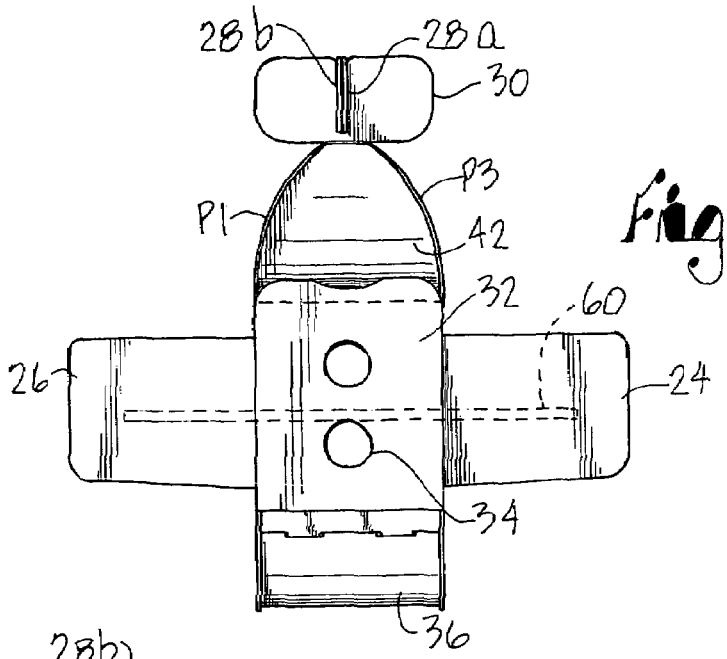
FIG. 9 is a top plan view of the assembled airplane carton showing the wings extended.
Figure 12:
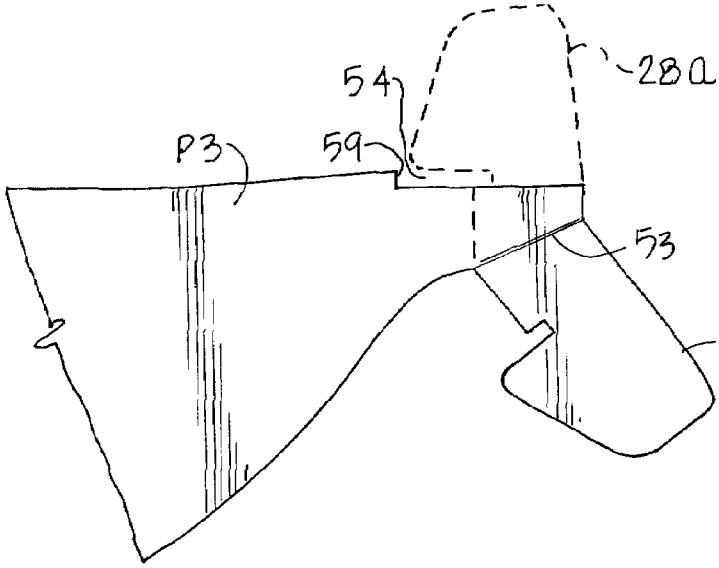
FIG. 12 is a detail view of the end of the one of the tapered tail sections showing the tail fin in broken lines in its assembled condition.

Completion of the fuselage and tail assembly is illustrated in FIGS. 6-8 and 12. Referring first to FIG. 12, the side of the tapered tail section of the airplane formed by panel P3 is shown in detail. In FIG. 12 panel P3 is shown in full lines prior to folding the tail fin section 28*a* to an upright, final position. This is accomplished by folding fin 28*a* at the fold line 53 as illustrated to present an upright tail fin 28*a* shown in broken lines in FIG. 12. Panel P1 has the same configuration as P3. The tail fin 28*b* at the rear end of panel P1 is likewise folded at a corresponding fold line (not shown) to an upright position in the same manner. Then, to complete assembly, the matching tail fin sections 28*a* and 28*b* are brought together, aligned and held while the stabilizer 30 is inserted into a slot 54 in each of the panels P1 and P3 presented by the upwardly folded fins 28*a* and 28*b*. The action of folding the tail fin sections 28*a*, 28*b* to the final, upright position and insertion of the stabilizer 30 into the slots 54 is illustrated in FIG. 6 where stabilizer 30 is shown in a vertical plane just prior to being rotated to a horizontal orientation and inserted as shown in FIG. 7. It should be noted, as shown in FIG. 5, that the stabilizer 30 has a central slot 56 therein extending fore and aft which mates with the slots 54 to provide a final tail configuration as shown in FIG. 8 and FIG. 9. Stabilizer 30 is held by a pair of shoulders 59 formed by a notch at the upper rear edge of each of the panels P1 and P2.

Figure 10:
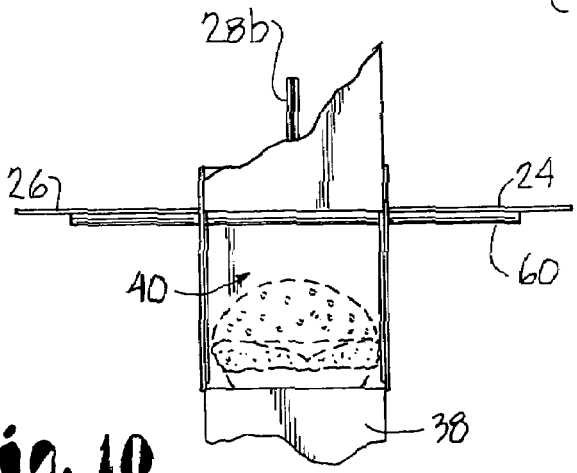
FIG. 10 is a front elevational view of the carton of FIG. 9, parts being broken away and the nose shown open to reveal details.
Figure 11:
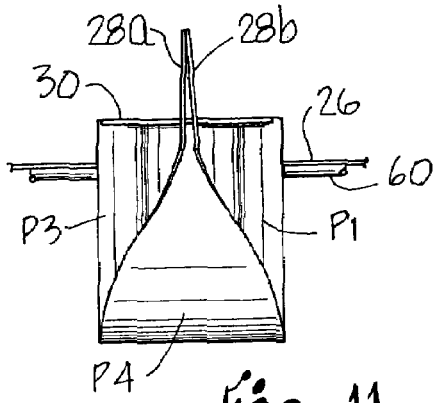
FIG. 11 is a rear elevational view of the assembled carton, the wings being partially shown.

To provide the wings of the aircraft, each of the panels P1 and P3 is provided with a fold line 58 as shown in FIGS. 1, 2, 7 and 8 and is die cut downwardly from the ends of the fold lines so that wings 24 and 28 may be rotated to a horizontal position and then held in place, for example, by an elongated rod 60 which, for convenience, may be a drinking straw. Aligned apertures (not shown in detail) are provided in panels P1 and P3 for the purpose of receiving the straw 60 so it may be placed in a final position as shown in FIGS. 9 and 10. Therefore, when fully assembled, the airplane carton presents a container for food and beverage or other items in the main compartment 40 and the bay 42, may be readily grasped and carried using the finger holes 34, provides an interesting and fanciful vehicle for presentation of the meal, and is readily disposable after use.

It is to be understood that while certain forms of this invention have been illustrated and described, it is not limited thereto, except insofar as such limitations are included in the following claims.

The invention claimed is:

1. A method of forming a food container having an airplane configuration, said method comprising the steps of:

(a) providing a cardboard-like sheet having a plurality of spaced fold lines defining a plurality of side-by-side panels presenting respective sections of an airplane-like body, including a right side panel of said body having a first upwardly tapered tail section provided with an initially downwardly projecting, right tail fin element having a slot therein open at a front edge thereof, a top panel of said body, a left side panel of said body having a second upwardly tapered tail section provided with an initially downwardly projecting, left tail fin element having a slot therein open at a front edge thereof, and a bottom panel of said body having a rearwardly tapered tail section terminating at a stabilizer having a slot therein open at a rear edge thereof, (b) folding said panels along said fold lines to provide an initial stage of assembly of a fuselage that defines a food compartment, (c) folding the tail fin elements to an upright, final position together in side-by-side relationship to present a tail fin unit, and (d) securing said stabilizer to said tail fin unit by mating the slot in the stabilizer with the slots in the tail fin elements to complete the assembly of the container.

2. A food container having an airplane configuration, said container comprising:

a cardboard-like sheet having a plurality of spaced fold lines defining a plurality of panels folded along said lines and presenting respective sections of an airplane-like body, including a right side panel of said body having a first upwardly tapered tail section provided with an initially downwardly projecting, right tail fin element having a slot therein open at a front edge thereof, a top panel of said body, a left side panel of said body having a second upwardly tapered tail section provided with an initially downwardly projecting, left tail fin element having a slot therein open at a front edge thereof, and a bottom panel of said body having a rearwardly tapered tail section terminating at a stabilizer having a slot therein open at a rear edge thereof, said panels presenting a fuselarge that defines a food compartment, said tail fin elements being folded to an upright, final position together in side-by-side relationship to present a tail fin unit, and said slot in the stabilizer being mated with the slots in the tail fin elements to secure the stabilizer to the tail fin unit.

* * * * *